US008967247B2

(12) United States Patent
Dickinson

(10) Patent No.: US 8,967,247 B2
(45) Date of Patent: Mar. 3, 2015

(54) MULTI-TASKING ROD GUIDE

(76) Inventor: Douglas Ray Dickinson, Houston, TX (US)

( * ) Notice: Subject to any disclaimer, the term of this patent is extended or adjusted under 35 U.S.C. 154(b) by 232 days.

(21) Appl. No.: 13/437,920

(22) Filed: Apr. 2, 2012

(65) Prior Publication Data

US 2012/0186807 A1 Jul. 26, 2012

Related U.S. Application Data

(60) Provisional application No. 61/471,196, filed on Apr. 3, 2011.

(51) Int. Cl.
*E21B 17/10* (2006.01)
*E21B 43/12* (2006.01)

(52) U.S. Cl.
CPC ..... *E21B 43/126* (2013.01); *E21B 17/1071* (2013.01)
USPC ..... 166/241.2; 166/241.1; 166/241.3; 166/241.6; 166/241.4; 175/394; 175/310; 175/323

(58) Field of Classification Search
USPC ..... 166/241.1–241.4, 241.6; 175/394, 310, 175/323
See application file for complete search history.

(56) References Cited

U.S. PATENT DOCUMENTS 3,414,690 A * 12/1968 Petersen ..... 175/391
4,206,713 A * 6/1980 Ryason ..... 110/347
5,277,254 A * 1/1994 Rullman et al. ..... 166/241.4

* cited by examiner

*Primary Examiner* — Kenneth L Thompson
*Assistant Examiner* — Taras P Bemko
(74) *Attorney, Agent, or Firm* — Harrison Law Office, P.C.

(57) ABSTRACT

A multi-tasking downhole rod guide for centralizing a downhole pump rod production tubing within production tubing, while simultaneously reducing abrasion and deterioration of the production tubing and engendering auxiliary pump-boosting functions. The rod guide is configured with an elongate helix having a continuous trough-like channel through which hydrocarbons flow upwardly under high pressure. As the pressurized hydrocarbons flow through a succession of plates at each equidistant helical level, the elongate helix rotates synchronously with the upwardly flowing hydrocarbons within the production tubing string.

23 Claims, 2 Drawing Sheets

MULTI-TASKING ROD GUIDE

RELATED APPLICATIONS

This application claims priority based upon U.S. Provisional Application Ser. No. 61/471,196 filed Apr. 3, 2011.

FIELD OF THE INVENTION

The present invention relates to a downhole rod guide apparatus, and more particularly relates to an apparatus for performing a rod guide centralizer function downhole within a well bore, while simultaneously performing tubing-abrasion-reduction and auxiliary pump-boosting functions, with concomitant minimal energy consumption.

BACKGROUND OF THE INVENTION

There have been developed several downhole rod guides for sustaining the centralized disposition of a pumping rod within a string of production tubing. It is well known that such conventional rod guides suffer from excessive wear and abrasion under the influence of upwardly streaming high-pressure hydrocarbons. Such hydrocarbon streams typically include abrasive solid materials such as sand and debris which drastically undermine rod guide life cycle particularly because these occluded materials are moving at high speed. In addition, these solids and other troublesome materials appreciated tend to inhibit the upwards hydrocarbon flow.

These and other known deficiencies in the rod guide art have continued to render sustaining continuous flow of hydrocarbons from subsurface formations via downhole pumping systems upwardly to the well surface elusive to remedy, and unduly expensive in view of the necessity to frequently conduct rod guide maintenance because of inherently short life cycles and substantial consumption of energy to sustain demanding pumping requirements. Accordingly, these limitations and disadvantages of the prior art are overcome with the present invention, wherein improved means and techniques are provided which are especially useful for pumping hydrocarbons to the well surface with minimal prerequisite maintenance and without consuming substantial extra energy.

SUMMARY OF THE INVENTION

Embodiments of the present invention afford a panoply of functions heretofore unknown in the downhole art. In particular, embodiments not only perform the well known rod guide centering function relied upon by practitioners in the art, wherein a string of interconnected rotating rods is centrally guided within production tubing, which, in turn, is circumscribed by well casing, but also simultaneously perform a plurality of supplemental functions crucial to efficient continuous lifting of hydrocarbons from a subsurface formation downhole to the well surface.

As will be understood by those skilled in the art, such embodiments may be adapted to effectively achieve the hydrocarbon pumping purposes contemplated hereunder for many variations of hydrocarbon pumping protocols such as are achieved primarily via circular pumps, and including jack pumps, centrifugal pumps, etc.—with minimal additional energy being consumed. For instance, embodiments may be molded to accommodate a variety of formations and therein be readily adapted to suit both rotating and reciprocating downhole pumping applications. Embodiments would be screwably secured, or secured via like connection, to the pump rod at the well base—at the point of downhole hydrocarbon extraction—and with the production tubing locked into place in a manner well known in the art. Thus, rod guide embodiments of the present invention are integrated with and disposed concentrically of the axial pump rod in order to perform the rod-centralizing function in a manner heretofore unknown in the art.

Embodiments of the multi-tasking rod guide taught herein preferably comprise an elongate helix, i.e., helical configuration, which, as clearly depicted in the drawings, incorporate a spiral configuration preferably nominally every 90°, but not limited to 90°, that continually rotates as hydrocarbons are urged upwardly from downhole, toward the well surface. It will be appreciated that this continual rotational action of upwardly-flowing hydrocarbons causes the helical structure contemplated by embodiments of the present invention to synchronously rotate along with the flowing hydrocarbons within production tubing and the like. It is estimated that, for every rotation of embodiments of the present invention, approximately a ½ inch lift is realized per 90° so that approximately 2 inches of hydrocarbon fluid are lifted for each rotation.

As will be hereinafter described, this helix structure is preferably configured to bias upward vertical hydrocarbon fluid movement more than horizontal hydrocarbon fluid movement. It will be understood that angular momentum is engendered and efficiently used to lift recovered hydrocarbons being driven by substantial upward pressure. An important aspect of embodiments hereof is that, in the course of achieving unprecedented efficient upward flow of hydrocarbon fluids, there is virtually no inhibiting influence manifest thereupon. Notwithstanding, of course, this paucity of inhibiting influences may be promoted by practitioners in the art invoking such commonly-applied devices as shim-stock, spacers, or otherwise adjusting string-connecting threads to facilitate a tight fit in rod guide embodiments for delivering optimum rotational efficiency contemplated hereunder.

Heretofore unknown in the rod guide prior art, preferred embodiments of the present invention configured with a slip ring or the like at the well surface enable conventional pump-driven rotation to be supplemented by booster pumping action which is effectuated when the "horse" pulls upwardly and downwardly—manifest as conventional pump action—while causing the pump rod to rotate, thereby causing upwardly-directed pumping action emanating downhole. It should be evident that that this rotational movement of the helical structure taught herein effectively fosters continuous upward hydrocarbon flow, since the crucial downhole pumping function has been unexpectedly and significantly enhanced. Furthermore, it will also be seen that embodiments of the present invention have been preferably structured in order to inherently impart unique dislodging and scooping functions at the well bottom via a specially-configured bottom-level member, wherein the downhole hydrocarbon stream is urged to enter a trough-like member functioning as if it were a track or channel of the helical structure and then this hydrocarbon stream is pushed upwards inherently synchronized with rotation of the centralizing rod guide, i.e., the hydrocarbon stream is urged upwardly under the forceful influence of the instant multi-function rod guide.

It has been found to be advantageous for embodiments of the present invention to be configured with a top-level member having a plurality of ball bearings or the like, preferably with four or six such ball bearings or the like, in order to facilitate fluid travel and flow mechanics as will hereinafter be described. It has also been found to be particularly effective, once the typical high-pressure hydrocarbon flow—as high as 4500 psi—reaches atop the production string, to include a spring-loaded retention member or the like to reduce counterproductive reverse flow upon the production string's upwardly-powered flow when pumping ceases. Embodiments should also preferably be structured with beveled edges or like structures to promote being seamlessly mated with the trough-like member taught herein.

Thus, it will be appreciated that preferred embodiments have been configured to eliminate and to avoid potentially troublesome backflow of hydrocarbons which have been pumped from downhole to the well surface. Since hydrocarbon backflow has essentially inherently been prevented, conventional procedures such as flow-line re-priming and the like have been rendered unnecessary. Accordingly, application of preferred embodiments of the instant multi-purpose rod guide flow-lines have inherently become devoid of the presence of any air.

Of course, as is well known by those skilled in the art, it is essential that any apparatus introduced into the production string sustain optimal hydrocarbon flow, i.e., avoid inhibiting upward flow of hydrocarbons. Accordingly, it has been found that helix configurations of the present invention should be in the range 90° to 180°, and preferably be in the range 110° to 130°, and more preferably be in the range 115° to 120°.

It will also be seen that embodiments of the present invention should preferably overlap the production string inner wall at the top portion of the well. To achieve this inner wall-overlap, a suitable predetermined portion of the inner wall should be cut out for snugly accommodating therewithin the implicated portion of the instant multi-tasking rod guide. As an example, for producing wells having 4 inch inside diameter production tubing, ¼ inch thick, a 5 inch top piece would be appropriate. The walls could be situated as 4½ inches with ¼ inch indenture achieved by cutting ⅛ inch into each side, to effectuate the prerequisite contemplated overlap. For this illustration having a 4 inch length from the offset and a ¼ inch cut into the inner surface of the wall, the extra pump-boosting pressure on upward hydrocarbon flow may be shown by the formula:

$$\text{Volume for rotation}=(\pi)\times(4\tfrac{1}{4}\text{ inch})\times(2\text{ inches}) \quad (1)$$

Practitioners in the art will recognize this relationship as corresponding to the volume of hydrocarbon liquid being lifted upon and through the helix structure of the present invention.

If rotation of the production string were to cease, then it is contemplated that the helix configuration taught by the present invention would be sealed because of consequent plugging that would be inherently effectuated.

Thus, it should be evident that important features of embodiments of the present invention are manifest as the elongate helical structure revolves each cycle through its heighth, thereby sustaining the centered position of the production rod, while simultaneously performing in-line booster pumping upon the upwards-flowing stream of hydrocarbons—in turn, urging the hydrocarbons upwardly through the trough-like channel path of the continuously rotating helix structure.

It will also be seen that preferred embodiments of the present invention should be designed with a plurality of sharp edge members at the bottom of the helix in order to break up accumulations or clumps of high-viscosity tar balls and the like, akin to the action of a conventional paper-cutter. By avoiding or at least minimizing the adverse impact of high viscosity clumps of tar balls, embodiments of the present invention tend to optimize the upward flow of hydrocarbons as contemplated hereunder.

It is accordingly an object of the present invention to provide a novel downhole rod guide that exceeds the capabilities and expectations of rod guides known in the art.

It is also an object and advantage of the present invention that a multi-tasking rod guide is disclosed that not only handily performs the centering function known in the art, but also affords auxiliary pumping to supplement upwardly pumping of hydrocarbons from the well-bottom and inherently imparts less abrasion on the contact surfaces of production string and casing walls, respectively.

It is also an object and advantage of the present invention that embodiments simultaneously perform a plurality of functions without substantially increasing the demand for consumption of energy.

These and other objects of the present invention will become apparent from the following specifications and accompanying drawings.

DETAILED DESCRIPTION

Reference is made herein to the figures in the accompanying drawings in which like numerals refer to like components. Table 1 enumerates the assigned numerals.

TABLE 1

Rod Guide Component Listing

| # | Component Name | Structure/Function | Remarks |
|---|---|---|---|
| 2 | pump rod | axial | |
| 5 | hydrocarbon stream | flowing upward toward surface | high-pressure stream |
| 10 | rod guide | | multi-functional |
| 15 | overlap-portion | overlaps casing internal wall per cut-out | |
| 30 | helical portion | elongate | continuously rotating |
| 40 | trough-like channel | manifest on each successive helical level | |
| 45 | entry point at bottom | entry into channel at bottom (lowest level) | |
| 50 | bevel | disposed on backside of helix | avoid contacting tubing |
| 55 | plurality of detents | limits movement of backflow preventer | |
| h | inter-level height | between each successive helical level | |
| 60 | plurality of plates | collection surface at each level | |
| 65 | collection plate | at each level | except top level |
| 66 | plurality of pillars | 4 per level; strengthens each level | |
| 68 | pillar | at each level | |
| 70 | top collection plate | at top level only | thicker for stability |
| 75 | opening | 90-120°; on back-flow preventer | |
| 80 | back-flow preventer | prevents reverse flow of hydrocarbons; preferably 6-8 sides, forms secure seal | prefer minimum 6 sides |
| 85 | plurality of rollers | ball bearings | |
| 100 | bottom scooping plate | configured with sharp edges to dislodge viscous hydrocarbons on well bottom | like snow shovel for cutting & scooping tar balls, etc. |
| 120 | plurality of sharp edges | breaking up clumps of high-viscosity tar balls, etc., at well-bottom | help optimize upward flow of hydrocarbon |
| 155 | well surface | | |
| 200 | production tubing | production string | |
| 225 | interior walls | | |

Referring to FIGS. 1-9, there is depicted a preferred embodiment of the present invention corresponding to a multi-tasking rod guide apparatus 10 circumscribing and centralizing pump rod 2 as will be hereinafter described.

Figure 1:
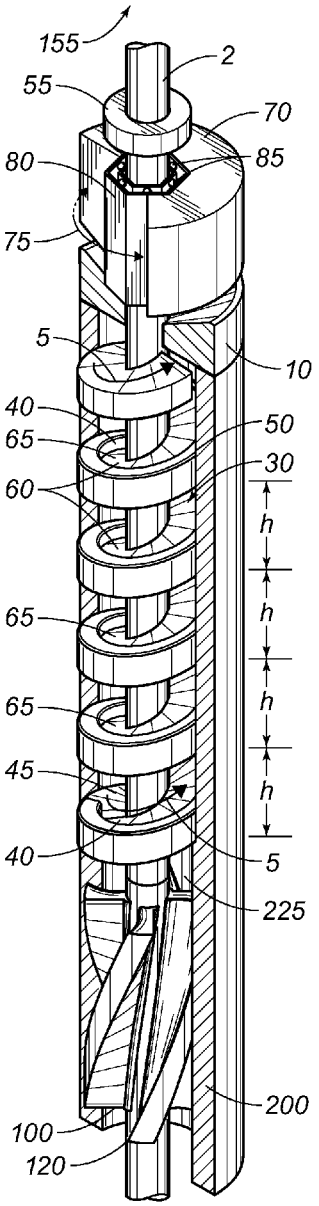
FIG. 1 depicts a frontal perspective view of a multi-tasking rod guide embodiment of the present invention, with half of the well casing removed.
Figure 2:
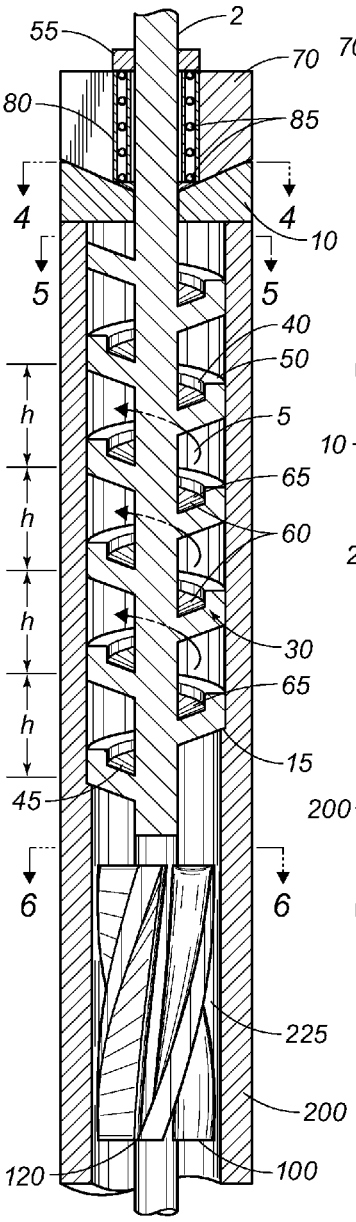
FIG. 2 depicts a cross-sectional view of the multi-tasking rod guide embodiment depicted in FIG. 1, and depicting a side view of the lower section thereof.
Figure 3:
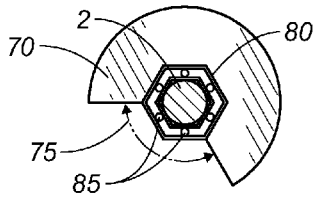
FIG. 3 depicts a top view of the backflow preventer feature of the multi-tasking rod guide embodiment of the present invention depicted in FIGS. 1 and 2.
Figure 4:
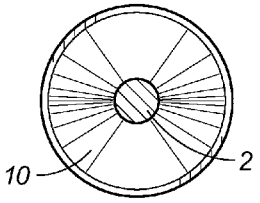
FIG. 4 depicts a top view of the multi-tasking rod guide embodiment depicted in FIG. 1.
Figure 5:
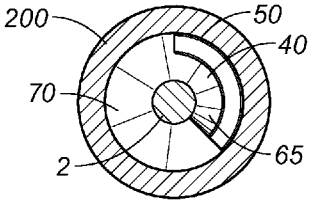
FIG. 5 depicts a cross-sectional view of the multi-tasking rod guide embodiment depicted in FIG. 2, wherein the section is depicted along line 4-4.
Figure 6:
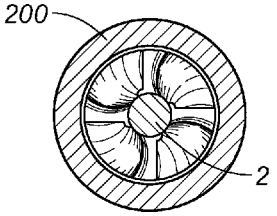
FIG. 6 depicts a cross-sectional view of the multi-tasking rod guide embodiment depicted in FIG. 2, wherein the section is depicted along line 5-5.
Figure 7:
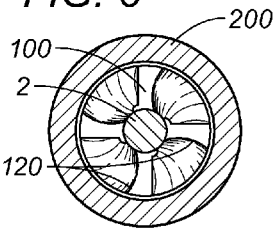
FIG. 7 depicts a bottom view of the multi-tasking rod guide embodiment depicted in FIGS. 1 and 2.
Figure 8:
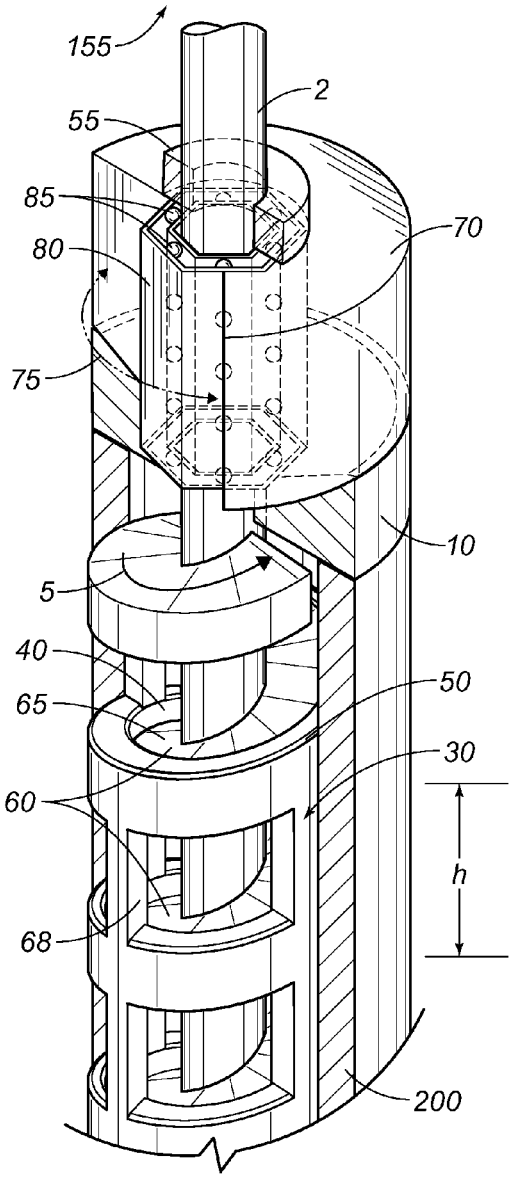
FIG. 8 depicts a frontal perspective view of a portion of the multi-tasking rod guide embodiment depicted in FIG. 1, featuring the backflow preventer contained in the top thereof.
Figure 9:
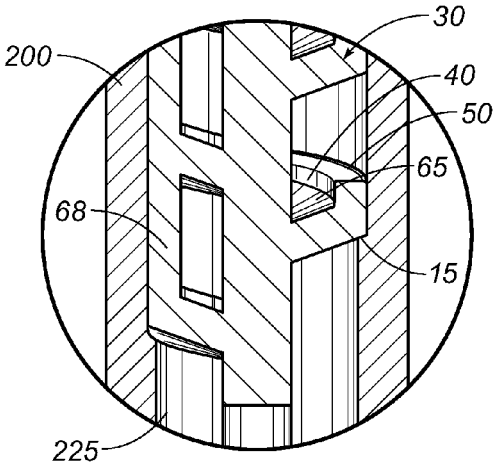
FIG. 9 depicts a frontal perspective view of a portion of the multi-tasking rod guide embodiment depicted in FIG. 2, featuring an intermediate plate member of its plurality of intermediate plate members.

Specifically referring now to FIGS. 1 and 2, there is depicted a frontal perspective view of the elongate continuous helical configuration 30 taught by the present invention and a corresponding frontal cross-sectional view thereof, respectively. In particular, the helix comprising helical portion 30 is elongated in a vertical orientation and comprises a continuous trough-like channel 40 disposed on each plate member 65 situated on each of a succession of helical levels of plurality of plate members 60. As depicted therein, each level of plurality of levels 60 comprises plate member 65. Thus, fluid hydrocarbon 5 is driven upwards via continuous trough or channel 40 and its implicated plurality of collection plates level members 60, and is ultimately delivered to well surface 155 under high-pressure.

As clearly shown in partial cut-away frontal view in FIG. 1, while helical member 30 comprises a plurality of levels 60 with each level 65 being virtually identical to the other, top-level collection plate member 70 and bottom level scooping plate member 100 are configured differently in order to afford specific functions as herein described. In particular, the angular disposition of plurality of plate members 60 and top-level collection plate member 70 are offset from 90° for enabling uninterrupted upward hydrocarbon flow through continuous channel 40. Bottom-level plate member 100 is configured at a steeper angle adjacent the well bottom in order to enable snow-shovel-like combined dislodging and scooping actions to facilitate, first, urging separation of viscous hydrocarbons 5, e.g., as tar balls and the like, from the well bottom and, second, urging entry of such dislodged and scooped viscous hydrocarbons into channel lowest level 45 and consequent upward travel thereof along the trough-like channel 40 manifest on each plate member 65 situated on each corresponding successive helical level member of plurality of level members 60, as hydrocarbon 5 is driven to the well surface 155 under high-pressure.

In order to enable this contemplated efficient scooping function, it has been found that offsets ranging from about 20° to 30° are preferred; it will be understood by practitioners skilled in the art that these preferred offsets correspond to angles of about 110° to 120° relative to the horizontal. Those conversant in the art will also note that the elongated helix located at the lower plate level of plurality of plates 60 is depicted in FIG. 2 with a bevel 50 disposed on the rear of the helix. This bevel configuration tends to avoid striking the production tubing 200 in a flat disposition, thereby affording extra support thereto, and smoothly commencing continuous upward helical movement thereof as contemplated hereunder.

Each successive level member 65 of this helical configuration should preferably be successively spaced apart equidistant in a vertical disposition with height "h" between each such level member being essentially identical to every other level-member height differential. For instance, in one application of instant multi-tasking rod guide 10, each helix level member 65 has been designed to measure approximately h=2% inches. With each level of helix 65 configured to be angled upwards, there is formed a trough-like channel 40 that tends to guide the pressure-driven continuous flow of hydrocarbon fluid 5 upwardly as the helix of the helical portion 30 is caused to rotate synchronously with hydrocarbon 5 within concentrically situated interior wall 225 of production tubing 200. Hydrocarbon fluid 5 ultimately reaches atop axial pumping rod 2 near well surface 155 and tends to be delivered via a squirting and spraying action thereof atop at helix level member 70, which serves as a collection plate or the like.

Thus, as clearly depicted in the partial cut-away views in each of FIGS. 1 and 2, top collection plate 70 contained at the upper level member of helix 30 is configured to be thicker than plurality of lower level members 60 of this helix structure. For the illustrative scenario hereinbefore referenced, having a preferred thickness of from about 1½ to 2 inches, top plate member 70 lends integrity atop production string 200 as high-pressure hydrocarbon stream 5 is thrust upon this uppermost plate member typically with a squirting action.

Now referring to FIGS. 1-3, 6, and 8, the backflow prevention aspect of the preferred embodiment is depicted. As will be appreciated by practitioners skilled in the art, backflow preventer 80 enables hydrocarbons 5 to continuously flow upwardly within production string 200 without being inhibited by contra-flowing hydrocarbons. In this preferred embodiment, reverse flow preventer 80 is structured in a hexagonal configuration with a plurality of rollers 85 or the like affixed on at least two of its sides in order to promote uninhibited rotational movement thereof and raising or lowering thereof as hydrocarbon flow conditions may dictate.

It is also an aspect of the present invention that the fit of backflow preventer 80 should preferably be essentially flush with interior walls 225 of production tubing 200 or include bevels 50 to assure that there is inherently no backflow so long as power is being supplied to the downhole pump system. Thus, where hydrocarbon 5 enters top helix plate 70 by a squirting and spraying action thereonto, this backflow preventer 80 should preferably fit snugly so as to securely seal hydrocarbon fluid 5 collected upon top-level member 70.

Based upon conditions prevalent in the downhole art, those skilled in the art will appreciate that it should generally be advantageous to provide the helical structure of the present invention with sides of ¾ to 1 inch width in order to achieve contemplated structural stability prerequisite for minimizing or even eliminating lateral movement thereof. In addition, it will also be understood that the clearance range of embodiments of the present invention are relatively small because of the extremely high pressures manifest during contemplated pumping of hydrocarbon towards the well surface. Indeed, based upon observations and experience in the art, a clearance as small as 0.01 inch may be too large and thus may be inadequate to be compatible with the protocol hereindescribed.

Accordingly, preferred embodiments of the present invention should have a clearance range of only 0.001 to 0.005 inch to effectively perform as hereindescribed. That is, affording a tight fit between the exterior of rod guide embodiments of the present invention and production tubing interior surfaces is crucial to the successful heretofore unrealized efficient upward flow of hydrocarbon fluid. In conjunction with the stable structures taught hereunder, such close tolerances prevent lateral shimmy effects or slipping of rod guide 10 annularly disposed between pump rod 2 and production tubing 200, thereby wholly avoiding consequent damage to production tubing attributable to scoring by grit and like foreign solid matter situated in situ with hydrocarbon 5 streaming upwardly to the well surface at high speeds and under high pressures.

Based upon conditions prevalent in the downhole art, it is generally advantageous to provide the helical structure of the present invention with sides of ¾ to 1 inch width in order to achieve contemplated structural stability for minimizing or even eliminating lateral movement. It will also be readily appreciated by practitioners familiar with adverse viscosity conditions in Venezuela and similar exigent environments, wherein tar and likewise viscous materials are unavoidably present, that, as depicted in FIGS. 1 and 2, bottom-level member 100 comprises plurality of specially-configured members 120 having sharp rib-like and blade-like members for inherently simultaneously cutting into and dislodging viscous, semi-solid and liquid hydrocarbons, thereby promoting upward flow thereof—under the influence of downhole pumping known in the art—but reinforced by the auxiliary pumping action taught by the present invention.

Moreover, it will be appreciated that, in such environments of extreme viscosity, embodiments of the present invention may optionally include any of several well known heating protocols to overcome pumping limitations. For instance, in one embodiment of the present invention, an electric heating member may be incorporated thereinto in order to further augment its extraordinary pumping capability. That is, based upon the novel helical structure taught herein, embodiments thereof may be invoked to supplement conventional pumping action and normal pump capabilities by tending to boost upward hydrocarbons fluid flow through its helical trough-like structure. It will be readily appreciated that this supplemental pumping aspect of the present invention continuously urges upward channel-flow of hydrocarbons until the top-level collection plate member has been reached and, ultimately, until the well surface has been reached shortly thereafter. It will also be understood that other environmental pumping limitations may be attributable to variation in temperature of downhole hydrocarbons so that a plethora of alternating hot spots and cold spots may be overcome by providing heat thereto, particularly at and/or near the well-bottom.

It will be understood that embodiments hereof have been structured to afford sufficient vertical support attributable to its inherent stability. Referring now to FIGS. 1-2, and 8-9, each pillar member 68 of plurality of pillar members 66 is disposed between each successive level member 65 of plurality of level members 60 to afford strength to the helical structure contemplated herein. Another aspect of this innate stability is the top-level plate structure which includes the hereinbefore described backflow preventer. More particularly, the opening 75 of this backflow preventer 80 is preferably 90° to 120° which corresponds to about ⅓ of 360°. Preferably constructed from solid metal or like strong and solid material, the backflow preventer acts like an immovable weight when it is caused to essentially drop into a 90° to 120° "hole" 75 if and when rotation abruptly ceases.

Ergo, it will be readily seen that backflow preventer 80 plugs the implicated 90°-120° hole 75, thereby preventing undesirable hydrocarbon backflow. It should be appreciated that the presence of a plurality of ball bearings on plurality of rollers 85 enable backflow preventer 80 to readily adapt as hydrocarbon fluid conditions vary, by appropriately sliding upwardly and downwardly to sustain optimal flow of hydrocarbon to the well surface. To further assure stable operation of embodiments of the present invention, a plurality of structural detent members 55 is disposed above the backflow preventer 80 to limit and control the extent of its upward movement. Embodiments of the backflow preventer may be configured with 8 sides instead of 6 sides especially to accommodate asynchronous rotation, thereby tending to effectively prevent hydrocarbon backflow under a diversity of demanding conditions.

Those skilled in the art will appreciate that the present invention seals off the high-pressures that are engendered downhole and that drive hydrocarbons to the well surface, and, in so doing, inherently restricts direct pressure from being imposed upon vertical side wall by deflecting direct pressure thereupon. There is no bleed-over manifest on the sides thereof, shielding the sides from astronomically high pressures from the surface.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. In a well having a pump rod interconnected with a downhole pump for pumping hydrocarbons from a subsurface formation to the surface of said well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.001 to 0.005 inch, and having a first plurality of successive plate members, with each said plate member having a collection plate and an adjacent continuous trough-like channel to enable continuous upward flow of said hydrocarbons to said well surface;

said first plurality of successive plate members disposed intermediately of a top-level collection plate member and a bottom-level dislodging member;

said top-level collection plate member configured with walls having thickness and strength to afford sufficient stability thereto for withstanding pressurized squirting and spraying action of said upwardly flowing hydrocarbons into said collection plate member thereof and to receive said continuous upward flow of said hydrocarbons for delivery thereof at said well surface;

said bottom-level dislodging member configured to dislodge said hydrocarbons from said downhole formation and to urge said dislodged hydrocarbons upwardly into said continuous trough-like channel;

said multi-tasking rod guide synchronously rotating with said hydrocarbons as said hydrocarbons flow upwardly through said continuous trough-like channel within said production string of said well, while simultaneously centralizing said pump rod and;

said elongate continuous helix further comprising said top-level collection plate member having at least a hexagonally-configured backflow prevention assembly comprising at least two series of rollers disposed on each of two opposing sides thereof to facilitate rotational movement thereof, for enabling said top-level collection plate member to accommodate said incoming stream of hydrocarbons and to prevent backflow thereof.

2. The multi-tasking rod guide apparatus recited in claim 1, wherein said backflow prevention assembly of said top-level collection plate member comprises an octagonal configuration.

3. The multi-tasking rod guide apparatus recited in claim 1, wherein each said plate member of said first plurality of collection plate members further comprises a second plurality of pillar members disposed vertical between each successive neighboring plate member to afford strength thereto as said pressurized upwardly-flowing hydrocarbons pass through said continuous trough-like channel and adjacent said plurality of collection plate members.

4. In a well having a pump rod interconnected with a downhole pump for pumping hydrocarbons from a subsurface formation to the surface of said well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.001 to 0.005 inch, and having a first plurality of successive plate members, with each said plate member having a substantially horizontal collection plate and being substantially identical with each other said plate member thereof and being spaced apart the same height from each other, and further configured with an adjacent continuous trough-like channel to enable continuous upward flow of said hydrocarbons to said well surface;

said first plurality of successive plate members disposed intermediately of a top-level collection plate member and a bottom-level dislodging member;

said top-level collection member configured to receive said continuous upward flow of said hydrocarbons for delivery thereof at said well surface;

said bottom-level dislodging member configured to dislodge said hydrocarbons from said downhole formation and to urge said dislodged hydrocarbons upwardly into said continuous trough-like channel; and said multi-tasking rod guide adapted to synchronously rotating with said hydrocarbons as said hydrocarbons flow upwardly through said continuous trough-like channel within said production string of said well, while simultaneously centralizing said pump rod.

5. The multi-tasking rod guide apparatus recited in claim 4, wherein said bottom-level member is configured with preferably an offset 110° to 120° relative to the horizontal.

6. The multi-tasking rod guide apparatus recited in claim 5, wherein said hydrocarbon flow upwardly through said continuous trough-like channel is achieved by pressurized movement of said hydrocarbon from said bottom-level dislodging member successively to one said plate member of said first plurality of successive plate members to the next upper said plate member of said first plurality of successive plate members, until said top-level collection plate member is reached for delivery of said upwardly flowing hydrocarbon to said well surface.

7. The multi-tasking rod guide apparatus recited in claim 6, wherein said dislodging bottom-level member comprises a second plurality of blade-like and rib-like members for dislodging and scooping said viscous hydrocarbons from said subsurface formation and for urging said dislodged hydrocarbon into said trough-like channel disposed at said well-bottom.

8. The multi-tasking rod guide apparatus recited in claim 4, wherein said top-level collection plate member is configured with walls having thickness and strength, for enabling said top-level member to afford sufficient stability thereto for withstanding pressurized squirting and spraying action of said upwardly-flowing hydrocarbons into said collection plate thereof.

9. The multi-tasking rod guide apparatus recited in claim 8, wherein said top-level collection plate member is configured with a substantially horizontal top opening to enable uninhibited pressurized collection of said hydrocarbons driven upwardly through said trough-like channel member via said pressurized squirting and spraying action onto said top-level collection plate for ultimate deposit thereof at the well surface.

10. The multi-tasking rod guide apparatus recited in claim 9, wherein said opening of said top-level collection plate member is configured with said substantially horizontal top opening corresponding to about ⅓ of said top-level collection plate member, preferably encompassing from 90° to 120° thereof.

11. The multi-tasking rod guide apparatus recited in claim 4, wherein said elongate continuous helix further comprises said top-level plate member having at least a hexagonally-configured backflow prevention assembly comprising at least two series of rollers disposed on each of two opposing sides thereof to facilitate rotational movement thereof, for enabling said top-level member to accommodate said incoming stream of hydrocarbon and to prevent backflow thereof.

12. The multi-tasking rod guide apparatus recited in claim 11, wherein said backflow prevention assembly of said top-level member comprises an octagonal configuration.

13. The multi-tasking rod guide apparatus recited in claim 12, wherein said elongate continuous helix further comprises a plurality of detent members affixed above said top-level plate member for limiting upward movement of said backflow prevention assembly.

14. The multi-tasking rod guide apparatus recited in claim 4, wherein each said plate member of said first plurality of collection plate members further comprises a third plurality of pillar members disposed vertical between each successive neighboring plate member to afford strength thereto as said pressurized upwardly-flowing hydrocarbons pass through said continuous trough-like channel and adjacent said plurality of collection plate members.

15. The multi-tasking rod guide apparatus recited in claim 4, wherein said helical member further comprises a bevel member located upon its rear surface, to avoid striking said production tubing in a flat disposition, thereby affording extra support thereto, and promoting uninhibited continuous upward helical movement thereof.

16. In a well having a pump rod interconnected with a downhole pump for pumping hydrocarbons from a subsurface formation to the surface of a well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.001 to 0.005 inch, and having a first plurality of successive plate members, with each said plate member having a substantially horizontal collection plate and being substantially identical with each other said plate member thereof and being spaced apart the same height from each other, and further configured with an adjacent continuous trough-like channel to enable continuous upward flow of said hydrocarbons to said well surface;

said first plurality of successive plate members disposed intermediately of a top-level collection plate member and a bottom-level dislodging member;

said top-level collection plate member further comprising configured with walls having thickness and strength, for enabling said top-level plate member to afford sufficient stability thereto for withstanding pressurized squirting and spraying action of said upwardly-flowing hydrocarbons into said top-level collection plate member thereof, and further configured with said substantially horizontal top opening corresponding to about ½ of said top-level collection plate surface, preferably from 90° to 120° thereof, to receive said continuous upward flow of said hydrocarbons for delivery thereof at said well surface;

said elongate continuous helix further comprising said top-level plate member having at least a hexagonally-configured backflow prevention assembly comprising at least two series of rollers disposed on each of two opposing sides thereof to facilitate rotational movement thereof, for enabling said top-level member to accommodate said incoming stream of hydrocarbon and to prevent backflow thereof, said bottom-level dislodging member comprising a second plurality of blade-like and rib-like members for dislodging and scooping said viscous hydrocarbons from said subsurface formation and for urging said dislodged hydrocarbon into said trough-like channel disposed at said well-bottom to dislodge said hydrocarbons from said downhole formation and to urge said dislodged hydrocarbons upwardly into said continuous trough-like channel; and said multi-tasking rod guide adapted to synchronously rotate with said hydrocarbon as said hydrocarbon flow upwardly through said continuous trough-like channel within said production string of said well, while simultaneously centralizing said pump rod.

17. The multi-tasking rod guide apparatus recited in claim 16, wherein said first plurality of successive plate bottom-level member of said continuous helix is configured with each said plate member preferably an offset 110° to 120° relative to the horizontal.

18. The multi-tasking rod guide apparatus recited in claim 16, wherein said hydrocarbons flow upwardly through said continuous trough-like channel is achieved by pressurized movement of said hydrocarbons from said bottom-level dislodging member successively to one said plate member of said first plurality of successive plate members to the next upper said plate member of said first plurality of successive plate members, until said top-level collection plate member is reached for delivery of said upwardly flowing hydrocarbons to said well surface.

19. The multi-tasking rod guide apparatus recited in claim 18, wherein said top-level collection plate member is configured with a top opening to enable uninhibited pressurized collection of said hydrocarbons driven upwardly through said trough-like channel member via said pressurized squirting and spraying action onto said top-level collection plate for ultimate deposit thereof at the well surface.

20. The multi-tasking rod guide apparatus recited in claim 18, wherein said backflow prevention assembly of said top-level member comprises an octagonal configuration.

21. The multi-tasking rod guide apparatus recited in claim 16, wherein said elongate continuous helix further comprises a plurality of detent members affixed above said top-level plate member for limiting upward movement of said backflow prevention assembly.

22. The multi-tasking rod guide apparatus recited in claim 16, wherein each said plate member of said first plurality of collection plate members further comprises a third plurality of pillar members disposed vertical between each successive neighboring plate member to afford strength thereto as said pressurized upwardly-flowing hydrocarbons pass through said continuous trough-like channel and adjacent said plurality of collection plate members.

23. The multi-tasking rod guide apparatus recited in claim 16, wherein said helical member further comprises a bevel member located upon its rear surface, to avoid striking said production tubing in a flat disposition, thereby affording extra support thereto, and promoting uninhibited continuous upward helical movement thereof.

* * * * *